US006368091B1

(12) United States Patent
Mito

(10) Patent No.: US 6,368,091 B1
(45) Date of Patent: Apr. 9, 2002

(54) SCREW ROTOR FOR VACUUM PUMPS

(75) Inventor: Masaru Mito, Yamaguchi (JP)

(73) Assignee: Taiko Kikai Industries Co., Ltd. (JP)

( * ) Notice: Subject to any disclaimer, the term of this patent is extended or adjusted under 35 U.S.C. 154(b) by 0 days.

(21) Appl. No.: 09/647,230

(22) Filed: Sep. 22, 2000

(30) Foreign Application Priority Data

Mar. 25, 1998 (JP) ..... 10-077240

(51) Int. Cl.[7] ..... F03C 2/00

(52) U.S. Cl. ..... 418/201.3; 418/150; 418/151; 418/201.1

(58) Field of Search ..... 418/201.3, 150, 418/151, 201.1

(56) References Cited

U.S. PATENT DOCUMENTS

| | | | | | |
|---|---|---|---|---|---|
| 2,705,922 | A | * | 4/1955 | Rathman | 418/201.1 |
| 4,758,138 | A | | 7/1988 | Timuska | |
| 4,984,974 | A | * | 1/1991 | Naya et al. | 418/201.1 |
| 4,995,797 | A | | 2/1991 | Tsuboi | |
| 5,667,370 | A | * | 9/1997 | Im | 418/201.1 |
| 5,697,772 | A | * | 12/1997 | Kawamura et al. | 418/150 |
| 5,797,735 | A | * | 8/1998 | Ishikawa et al. | 418/151 |
| 5,800,151 | A | * | 9/1998 | Kawamura et al. | 418/150 |

FOREIGN PATENT DOCUMENTS

| | | | | | |
|---|---|---|---|---|---|
| EP | 0389036 | | | 9/1990 | |
| EP | 496170 | A2 | * | 7/1992 | 418/151 |
| JP | 62-291486 | | * | 12/1984 | 418/201.1 |
| JP | 61-171891 | | | 10/1986 | |
| JP | 1-80688 | | | 5/1989 | |
| JP | 2-17716 | | | 4/1990 | |
| JP | 2-135689 | | | 11/1990 | |
| JP | 2-275089 | | | 11/1990 | |
| JP | 2-283890 | | | 11/1990 | |
| JP | 4-43884 | | | 2/1992 | |
| JP | 04-183990 | | * | 6/1992 | 418/150 |
| JP | 8-74765 | | | 3/1996 | |
| JP | 08-277790 | | * | 10/1996 | 418/201.1 |
| JP | 09-264276 | | * | 10/1997 | 418/150 |

* cited by examiner

*Primary Examiner*—Thomas Denion
*Assistant Examiner*—Theresa Trieu
(74) *Attorney, Agent, or Firm*—Baker & Daniels

(57) ABSTRACT

The moment Mo of unbalanced forces Fr of a screw rotor A1 is reduced by adjusting the number of thread leads of a threaded portion 2 of the screw rotor A1 to (an integer +0.5). The amount of unbalance for keeping a state of dynamic balance thereby decreases, and the drilling of a thread e for keeping the state of the dynamic balance is made easier.

3 Claims, 3 Drawing Sheets

PRIOR ART

SCREW ROTOR FOR VACUUM PUMPS

TECHNICAL FIELD

The present invention relates to a screw rotor in a spiraxial screw rotor type vacuum pump.

BACKGROUND OF THE INVENTION

The spiraxial screw rotor type vacuum pump is a pump in which a pair of right-hand screw rotor and left-hand screw rotor having a plurality of threads (number of leads) are engaged with each other and rotate in a casing. Because such a pump has high pumping efficiency, it has been used not only as an ordinary pump for supplying a fluid but has been widely used as a vacuum pump.

As shown in FIG. 4, a shape of a screw rotor A in a section perpendicular to its axis is composed of a Quimby curve a, a circular arc b of a thread bottom, a quasi-Archimedean spiral curve c and a circular arc d of an outer diameter. Since a center of gravity G of the rotor is positioned eccentrically from a rotation axis of the screw rotor in a direction of $\phi$, an unbalanced mass is created at rotation.

Meanwhile, in order to minimize the screw rotor type vacuum pump, it is necessary to rotate the screw rotor at a high speed. Because leaking amount of the fluid to be supplied is considered to be constant irrespective of rotation number, and the higher the rotation speed becomes, the more capacity efficiency will be enhanced, it is desired to make the screw rotor rotatable at the high speed. However, due to the unbalanced mass of the screw rotor as described above, vibrations will occur with the high speed rotation.

In view of the above, in order to use the screw rotor type vacuum pump with high efficiency taking its advantages into account, the screw rotor type vacuum pump must be such that it can be used even in a high speed rotation range. For this reason, it is necessary to improve the rotor balance to reduce the vibrations which occur in the high speed rotation range. For this purpose, the applicant has proposed in Japanese Patent Publication No. 2-17716 a screw rotor in which a static balance is set by making the leads of the threads in the screw rotor to be an even number, and a dynamic balance is set by providing cavities in thread ridges on both ends of the screw rotor, or by casting a light material into the cavities.

In order to set the dynamic balance by providing the cavities in the thread ridges on both the ends of the screw rotor, a core for forming the cavities must be large and rigid. In case where the core is small and fragile in shape, there will be created a core displacement or a crack when the rotor is cast, and precise cavities cannot be formed.

In the meantime, as a demand for a smaller sized vacuum pump is prevailing in the market, if a lead length L as shown in FIG. 5A is reduced to a lead length L' as shown in FIG. 5B, a thread e is reduced in thickness to form a thin thread e'.

It is difficult to produce small cavities in the thin thread e' by casting, and it has been only means to set the balance by drilling.

Even by drilling, only a small unbalanced amount can be removed from the thin thread e', and therefore, the unbalanced amount must be as small as possible.

The applicant has conducted tests varying total lengths of the threaded portion of the screw rotor, and found that an unbalanced moment of the screw rotor becomes least when the total length of the threaded portion is under a determined condition.

The present invention has been made on the basis of the result of the tests, and an object of the invention is to provide a screw rotor for a vacuum pump which has the least unbalanced moment.

DISCLOSURE OF THE INVENTION

In order to attain the above described object, there is provided a spiraxial screw rotor type vacuum pump, in which a pair of right-hand screw rotor and left-hand screw rotor, a section perpendicular to each axis of which is asymmetrically formed by a Quimby curve, a circular arc and a quasi-Archimedean spiral curve, are engaged with each other, characterized in that number of thread leads of threaded portions in the screw rotors is (an integer +0.5), thereby to decrease unbalanced moments of the screw rotors.

BEST MODE FOR CARRYING OUT THE INVENTION

Now, referring to the attached drawings, an embodiment of the present invention will be described.

Figure 1:
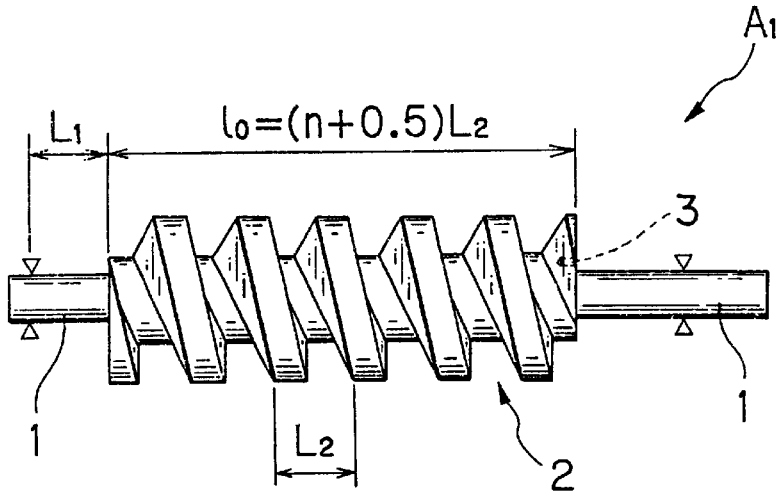
FIG. 1 is a front view of a screw rotor according to the present invention for describing dimensions of the screw rotor.
Figures 2A, 2B, 2C:
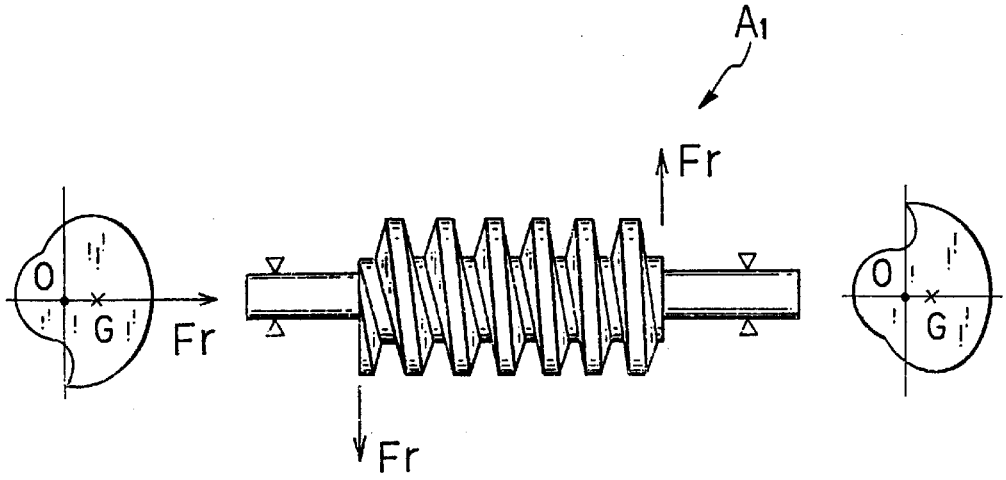
FIGS. 2A, 2B and 2C are a front view, and side views as seen from the left and the right respectively of the screw rotor for explaining a state where unbalanced forces are created.
Figure 6:
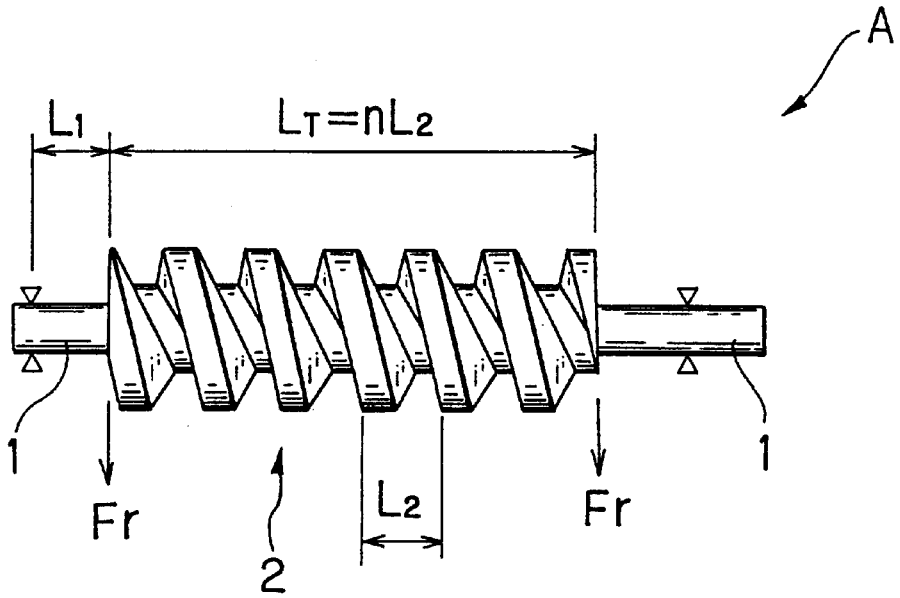
PRIOR ART FIG. 6
FIG. 6 is a front view of a conventional screw rotor A as compared with the screw rotor according to the present invention.

FIG. 1 is the front view of the screw rotor A1 according to the present invention for describing the dimensions of the screw rotor, FIGS. 2A, 2B and 2C are the front view, and the side views as seen from the left and the right respectively of the screw rotor A1 for explaining the state where the unbalanced force is created, and FIG. 6 is the front view of the conventional screw rotor A1 as compared with the screw rotor A1 according to the present invention.

The screw rotor A1 according to the present invention is composed of a threaded portion 2, and shaft portions 1 provided on both sides of the threaded portion 2, in the same manner as the conventional screw rotor A. The threaded portion 2 has the same shape as that of the conventional screw rotor A in a section perpendicular to the axis.

The shaft portions 1 are rotatably supported by means of bearings which are provided in a casing of a vacuum pump in the same manner as those of the conventional screw rotor A, except that number of thread leads of the threaded portion 2 in the screw rotor A1 in this invention is different from that of the conventional screw rotor A.

The present invention is characterized in that in case where a length of one lead is L2, the total length L0 is as follows;

$$L0=(n+0.5)L2 \text{ (n:integer)}$$

Unbalanced forces Fr in this case function as couple of forces as shown in FIG. 2A, and a moment M0 of the unbalanced forces Fr is represented by the following formula (1), in case where a length of one (left hand ) of the shaft portions 1 is L1;

$$M0 = Fr \cdot L1 - Fr(L1 + nL2 + 0.5L2) \quad \text{Formula(1)}$$
$$= -Fr(n + 0.5)L2$$

FIGS. 2B and 2C are the side views as seen from the left and the right in which a position of a center of the gravity with respect to the axial center O is shown.

In case where a total length LT of the threaded portion 2 of the conventional screw rotor A is set to be Lr=nL2, the unbalanced forces Fr will be in the same direction. Accordingly a moment MT of the unbalanced forces Fr is represented by the following formula (2);

$$MT = Fr \cdot L1 + Fr(L1 + nL2) \quad \text{Formula(2)}$$
$$= Fr(2L1 + nL2)$$

A difference of the unbalanced moments between the formula (1) and the formula (2) is;

$$|MT| - |M0| = 2Fr \cdot L1 + Fr \cdot nL2 - Fr \cdot nL2 - 0.5Fr\ L2 \quad \text{Formula(3)}$$
$$= (2L1 - 0.5\ L2)Fr$$

It has been thus proved that the unbalanced moment is decreased by an amount represented by the formula (3) in the present invention.

Figure 3:
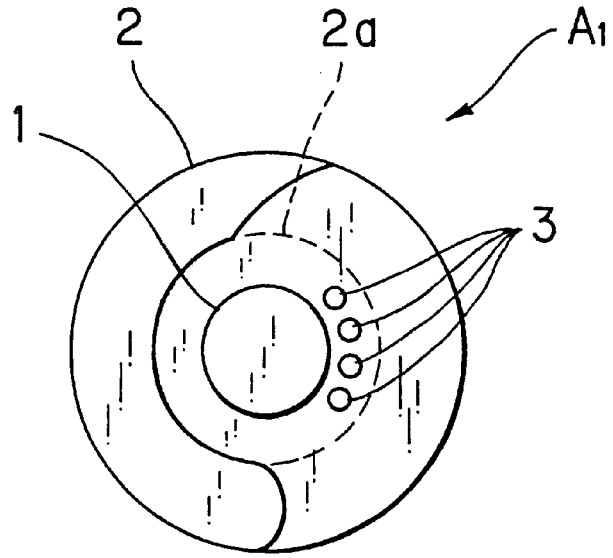
FIG. 3 is a side view of the screw rotor showing balancing holes for setting a dynamic balance.
Figure 4:
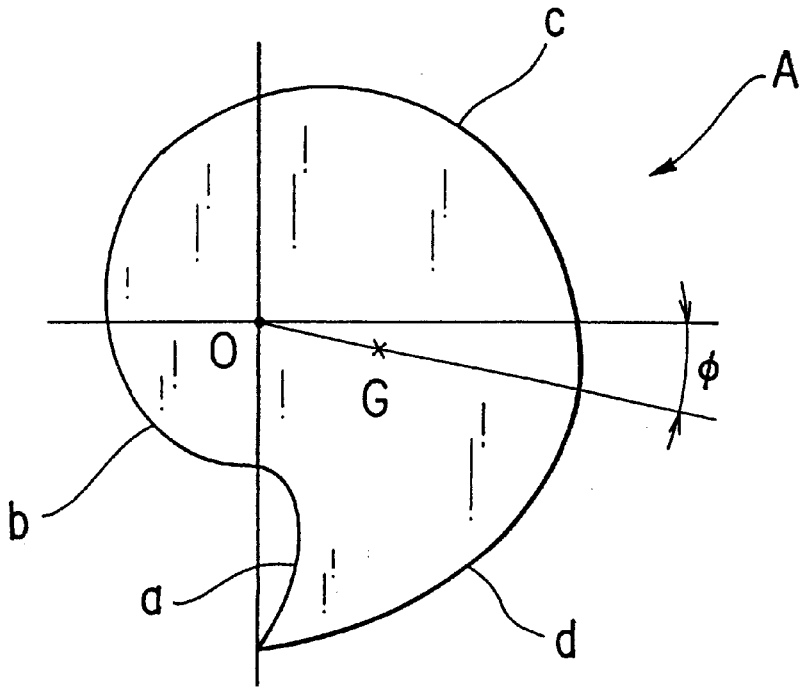
FIG. 4 is a sectional view perpendicular to an axis of a threaded portion of the screw rotor.
Figure 5A:
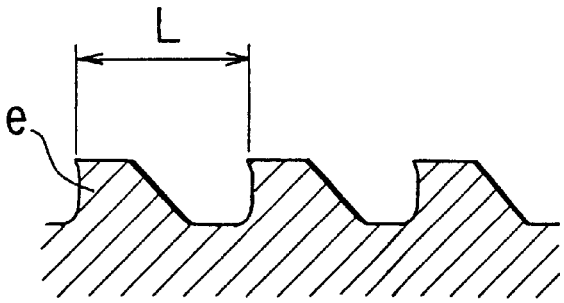
FIGS. 5A and 5B are sectional views in an axial direction of threads for explaining that shapes of the threads change according to lead lengths of the threads.
Figure 5B:
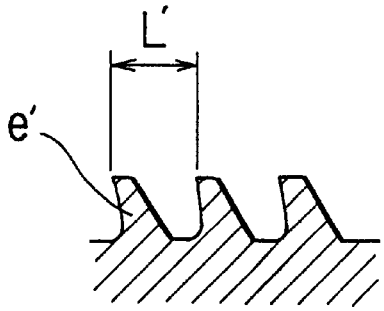
PRIOR ART FIG. 5B

According to the invention, the unbalanced moment can be decreased as described above. Therefore, in case where it is difficult to provide cavities in a thread e' of the threaded portion 2 (see FIG. 5B), balancing blind holes 3 can be easily formed by drilling in end faces between an outer face of the shaft portion 1 and a thread bottom 2*a* of the threaded portion 2 as shown in FIGS. 2 and 3.

INDUSTRIAL APPLICABILITY

As described hereinabove, by adjusting the total length of the threaded portion in the screw rotor to the sum of (an integer n +0.5) according to the present invention, the unbalanced moment of the screw rotor can be reduced, whereby drilling of the balancing holes for setting the dynamic balance has been made easier.

What is claimed is:

1. A spiraxial screw rotor type vacuum pump, in which a pair of right-hand screw rotor and left-hand screw rotor, a section perpendicular to each axis of which is asymmetrically formed by a Quimby curve, a circular arc and a quasi-Archimedean spiral curve, are engaged with each other, characterized in that number of thread leads of threaded portions in said screw rotors is (an integer +0.5), thereby to decrease unbalanced moments of said screw rotors.

2. A pump according to claim 1, wherein the rotor is provided with at least one balancing blind hole between a shaft of said rotor and a thread bottom of the thread portion to reduce unbalanced moments of said rotor.

3. A pump according to claim 2, wherein the balancing blind hole comprises a drilled hole.

* * * * *

UNITED STATES PATENT AND TRADEMARK OFFICE

CERTIFICATE OF CORRECTION

PATENT NO. : 6,368,091 B1
DATED : April 9, 2002
INVENTOR(S) : Masaru Mito

It is certified that error appears in the above-identified patent and that said Letters Patent is hereby corrected as shown below:

Title page,
Please change line item [22] as follows and add line item [86] as follows:

-- [22] PCT Filed: April 30, 1998

[86] PCT No.: PCT/JP98/01982
§371 Date: Sept. 22, 2000
§102(e) Date: September 22, 2000 --

Signed and Sealed this

Seventeenth Day of September, 2002

*Attest:*

*Attesting Officer*

JAMES E. ROGAN
*Director of the United States Patent and Trademark Office*